US007833039B2

(12) United States Patent
Chang

(10) Patent No.: US 7,833,039 B2
(45) **Date of Patent: *Nov. 16, 2010**

(54) ELECTRICAL CONNECTOR AND CONDUCTING TERMINAL USED THEREIN

(75) Inventor: Mu-Lin Chang, Hsien Shi Town (TW)

(73) Assignee: K.S. Terminals Inc., Chang Hwa County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/581,962

(22) Filed: Oct. 20, 2009

(65) Prior Publication Data

US 2010/0041282 A1 Feb. 18, 2010

Related U.S. Application Data

(63) Continuation of application No. 12/003,444, filed on Dec. 26, 2007, now Pat. No. 7,628,630.

(30) Foreign Application Priority Data

Jul. 6, 2007 (TW) ..... 96124600 A

(51) Int. Cl.
*H01R 25/00* (2006.01)

(52) U.S. Cl. ..... 439/295; 439/862

(58) Field of Classification Search ..... 439/284, 439/862, 295, 293

See application file for complete search history.

(56) References Cited

U.S. PATENT DOCUMENTS

| | | | | |
|---|---|---|---|---|
| 3,259,870 | A | 7/1966 | Winkler | |
| 3,909,099 | A | 9/1975 | Winkler | |
| 6,790,067 | B2 * | 9/2004 | Douty et al. | 439/284 |
| 7,001,194 | B2 * | 2/2006 | Yang et al. | 439/295 |
| 7,108,534 | B2 * | 9/2006 | Fabian | 439/284 |
| 7,153,152 | B1 | 12/2006 | Eby et al. | |
| 7,494,359 | B2 * | 2/2009 | Ragnarsson | 439/284 |

* cited by examiner

*Primary Examiner*—Hien Vu
(74) *Attorney, Agent, or Firm*—Ming Chow; Sinorica, LLC

(57) ABSTRACT

The present invention provides an electrical connector and a conducting terminal thereof. Particularly, the present invention provides a conducting terminal having enhanced structural strength in virtue of a lumbar portion and a supporting means. The conducting terminal includes a longitudinal axis and a proximal end, a lumbar portion and a distal end extended along the longitudinal axis, respectively. The proximal end is bent in a waved form so as to provide an elastically deforming capability. A free end is provided with an engaging surface. The distal end is in a barrel shape. A prop surface is provided near the lumbar portion. The supporting means is protruded from the lumbar portion toward the prop surface. The engaging surface and the lumbar portion have respective normal lines thereof intersecting the longitudinal axis.

4 Claims, 7 Drawing Sheets

ELECTRICAL CONNECTOR AND CONDUCTING TERMINAL USED THEREIN

CROSS-REFERENCE TO RELATED APPLICATIONS

This application is a continuation of application Ser. No. 12/003,444 filed on Dec. 26, 2007 now U.S. Pat. No. 7,628,630.

FIELD OF THE INVENTION

The present invention provides an electrical connector and a conducting terminal used therein; particularly, the present invention provides an electrical connector that can be used by coupling with another one as a pair.

BACKGROUND OF THE INVENTION

A conducting terminal of a conventional electrical connector is composed of a longitudinal axis and a proximal end as well as a distal end extended along the longitudinal axis, and embedded in an insulating housing. Therein, an engaging surface of the proximal end is used for electrical signal connection so as to achieve electrical conduction between connectors. However, frequent use of the conventional conducting terminal will cause breakage of the conducting terminal because of the destructing force accumulated on the engaging surface between the proximal end and the distal end of the conducting terminal. As a result, the electrical connector will eventually lose electrical signal connection. The U.S. Pat. No. 3,259,870, herein referred to as Prior Art 1, provides an electrical connector, utilizing a cylindrical portion 20 and a terminal member 22 to form a conducting terminal. The conducting terminal is connected to a leaf spring 28 through a groove 26, and formed into an electrical connector with an insulating housing 14. The connecting interface of the cylindrical portion 20 and the terminal member 22 is not designed with a strong structure, and thus the conducting terminal will break and lose its effect after frequent plugging and unplugging. Additionally the U.S. Pat. No. 3,909,099, herein referred to as Prior Art 2, also provides an electrical connector, utilizing a back cylindrical terminal member 16 to form a conducting terminal. The conducting terminal and a spring 20 are connected, and formed into an electrical connector with an insulating housing 14. The connecting interface of the back cylindrical portion 22 is not designed with a strong structure, and thus the conducting terminal will break and lose its effect after frequent plugging and unplugging. Finally, the U.S. Pat. No. 7,153,152, herein referred to as Prior Art 3, provides an electrical connector; wherein a conducting terminal 14 in use therewith has a proximal end 16 with an engaging surface 30 so as to engage with a supporting spring.

The connecting interface of the back cylindrical terminal member and the front portion of the conventional conducting terminal are not designed with a strong structure, and thus the conducting terminal will break and lose its effect after frequent plugging and unplugging. Therefore, there is a need for improvement in this field of art.

SUMMARY OF THE INVENTION

To solve the aforementioned problems, the present invention provides an electrical connector with high structural strength; wherein, a conducting terminal used in the electrical connector includes a longitudinal axis and a proximal end, a lumbar portion and a distal end extended along the longitudinal axis. The proximal end is bent in a waved form so as to provide a elastically deforming capability. A free end of the proximal end is provided with an engaging surface. The distal end is in a barrel shape. A prop surface is provided at the distal end adjacent to the lumbar portion. A supporting means is protruded from the lumbar portion toward the prop surface. The engaging surface and the lumbar portion have respective normal lines thereof intersecting with the longitudinal axis.

Thus, an object of the present invention is to provide an electrical connector with a conducting terminal, wherein the conducting terminal has improved structural strength.

Another object of the present invention is to provide an electrical connector with a conducting terminal, wherein the conducting terminal has a longer lifetime.

Yet another object of the present invention is to provide a conducting terminal of an electrical connector having improved structural strength.

Yet another object of the present invention is to provide a conducting terminal of an electrical connector having a longer lifetime.

Yet another object of the present invention is to provide a fabrication method of a conducting terminal, wherein the conducting terminal has improved structural strength.

Yet another object of the present invention is to provide a fabrication method of a conducting terminal of an electrical connector having a longer lifetime.

DETAILED DESCRIPTION OF THE EMBODIMENTS

Since the present invention provides an electrical connector and a conducting terminal as well as a fabrication method of the conducting terminal, the principle of electrical conduction utilized has already been disclosed in the prior art, and thus description with regards to the method of electronic conduction and electrical signal transmission will not be explained in detail. The drawings shown are not depicted in actual size and are only intended to express schematic views of the characteristics of the present invention.

Figure 1:
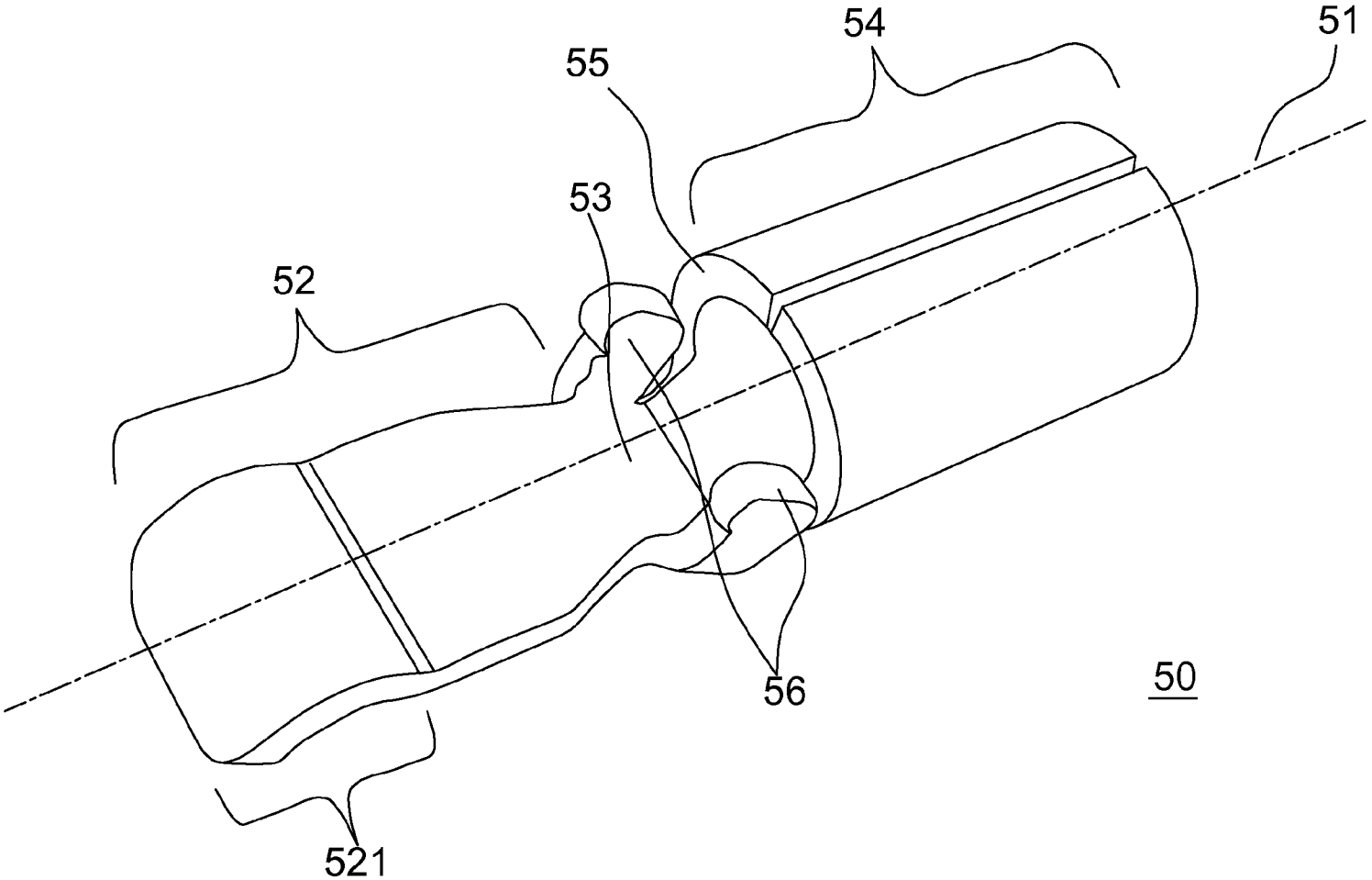
FIG. 1 is a perspective view of the conducting terminal in accordance with the present invention.
Figure 2:
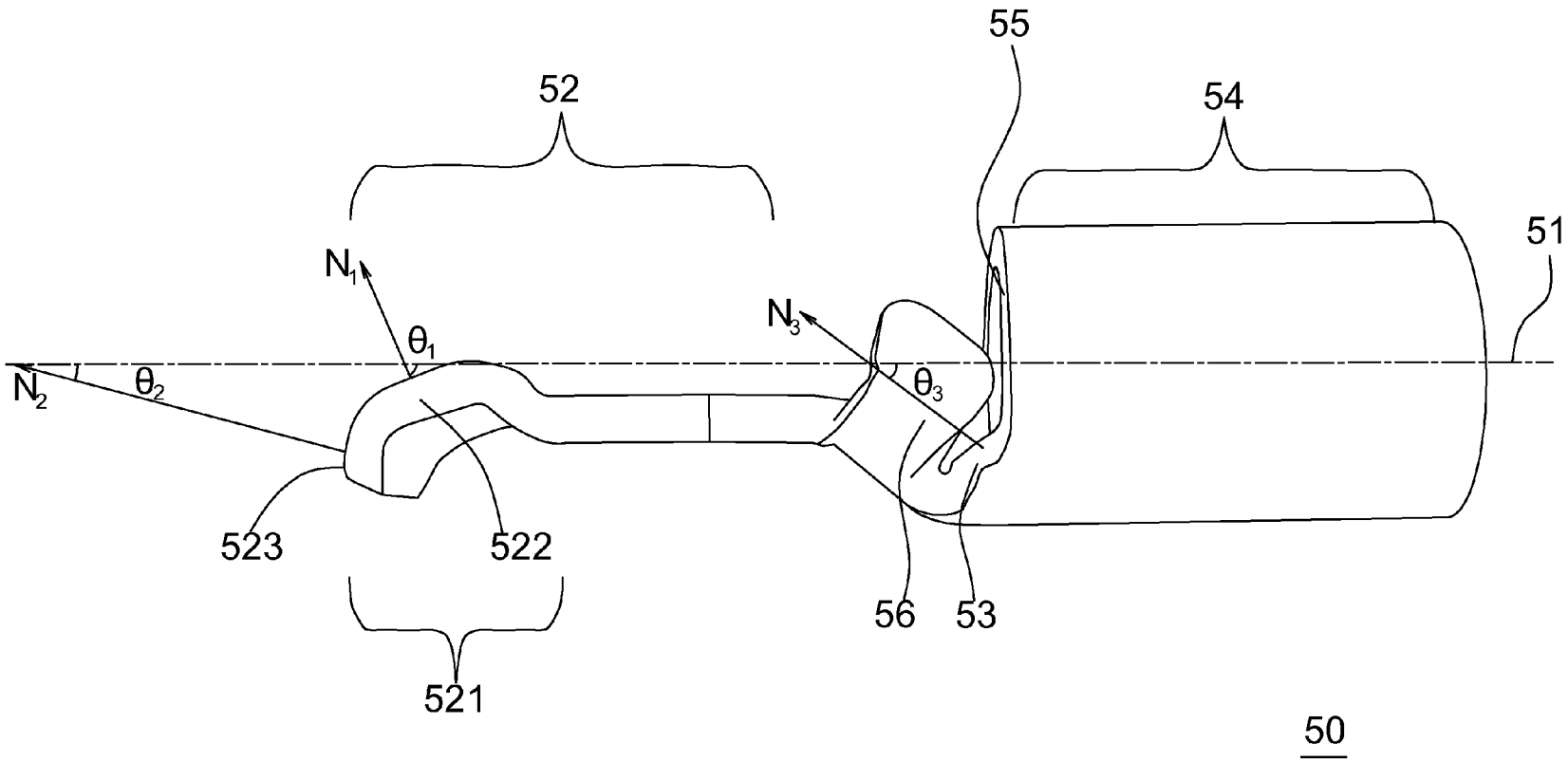
FIG. 2 is a side view of the conducting terminal in accordance with the present invention.

First, please refer to FIGS. 1 and 2, which illustrate a perspective view and a side view of the conducting terminal in a first preferred embodiment of the present invention. The conducting terminal 50 includes a longitudinal axis 51 and a proximal end 52, a lumbar portion 53 and a distal end 54 extended along the longitudinal axis 51. As shown in FIG. 2, the proximal end 52 is bent in a waved form such that when the conducting terminal is engaged with another conducting terminal, the waved form provides elastic deformation at the same time as the deformation is caused by contact force. A free end 521 of the proximal end 52 has an engaging surface 522. The engaging surface 522 and the lumbar portion 53 have a first normal line N1 and a third normal line N3, respectively, for intersecting the longitudinal axis 51 so as to act as a contact surface when the conducting terminal 50 is in connection with another conducting terminal 50.

The distal end 54 is in a barrel shape. If it is fabricated by metal stamping, then a slit is formed along the longitudinal axis thereof; if it is made from a tubular part, then it is formed in a simple barrel shape. Between the distal end 54 and the proximal end 52, there is the lumbar portion 53. The lumbar portion 53 is mainly used as a buffer portion intermediating between the varied structures of the terminal. However, due to the repeated plugging of the conducting terminal, fatigue stress is generally concentrated in this portion. A prop surface 55 is provided at the distal end 54 adjacent to the lumbar portion 53 for contacting with a supporting means 56, and dissipating the fatigue stress thereto so as to reduce the deformation.

In order to improve the structural strength of the lumbar portion 53, the present invention provides the supporting means 56 extended from the lumbar portion 53 toward the prop surface 55. As a result, the conducting terminal 50 can be prevented form being destroyed under an excessive deformation caused by an excessively applied force. In the preferred embodiment, the supporting means 56 is configured in pairs and extended from the two sides of the lumbar portion toward the prop surface 55. The supporting means 56 is in a flat shape, or a curved shape, or in any other structure so as to enhance the stiffness against to the deformation; wherein it is preferred to have a clearance between the supporting means 56 and the prop surface 55 so as to provide a buffer space for the deformation of the conducting terminal. In order to achieve a better electrical contact and stiffness, the lumbar portion 53 is configured in the manner that the third normal line N3 thereof intersects the longitudinal axis 51 at an intersection angle θ3 between 40 and 80 degrees. Similarly, the engaging surface 522 is configured in the manner that the first normal line N1 normal line thereof intersects the longitudinal axis 51 at an intersection angle θ1 between 40 and 80 degrees. The engaging surface 522 is further provided with a slanting portion 523. Furthermore, the slanting portion 523 is configured in the manner that a second normal line N2 thereof intersects the longitudinal axis 51 an intersection angle θ2 smaller than the angle θ1 between the first normal line N1 of the engaging surface 522 and the longitudinal axis 51. Particularly, the angle θ2 is between 10 and 40 degrees and preferably at 15 degrees.

Material of the conducting terminal 50 may be preferably selected with high conductivity, such as brass, bronze, copper alloy, aluminum, aluminum alloy, or gold, etc.

For the purpose of high stiffness, material of the conducting terminal 50 may be preferably selected such as stainless steel, K gold, or platinum, etc.

Figure 3:
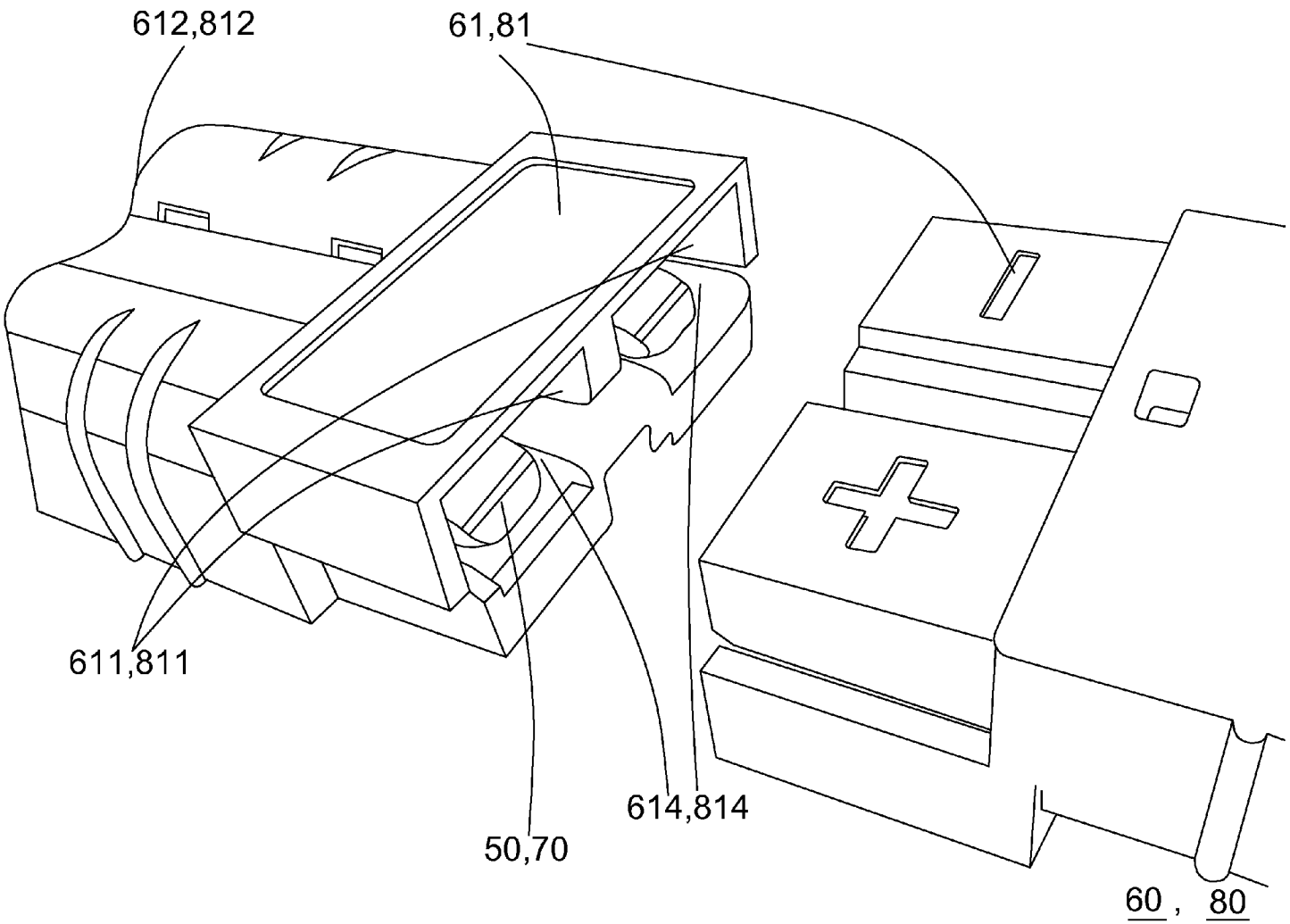
FIG. 3 is a perspective view of the electrical connector in accordance with the present invention.
Figure 4:
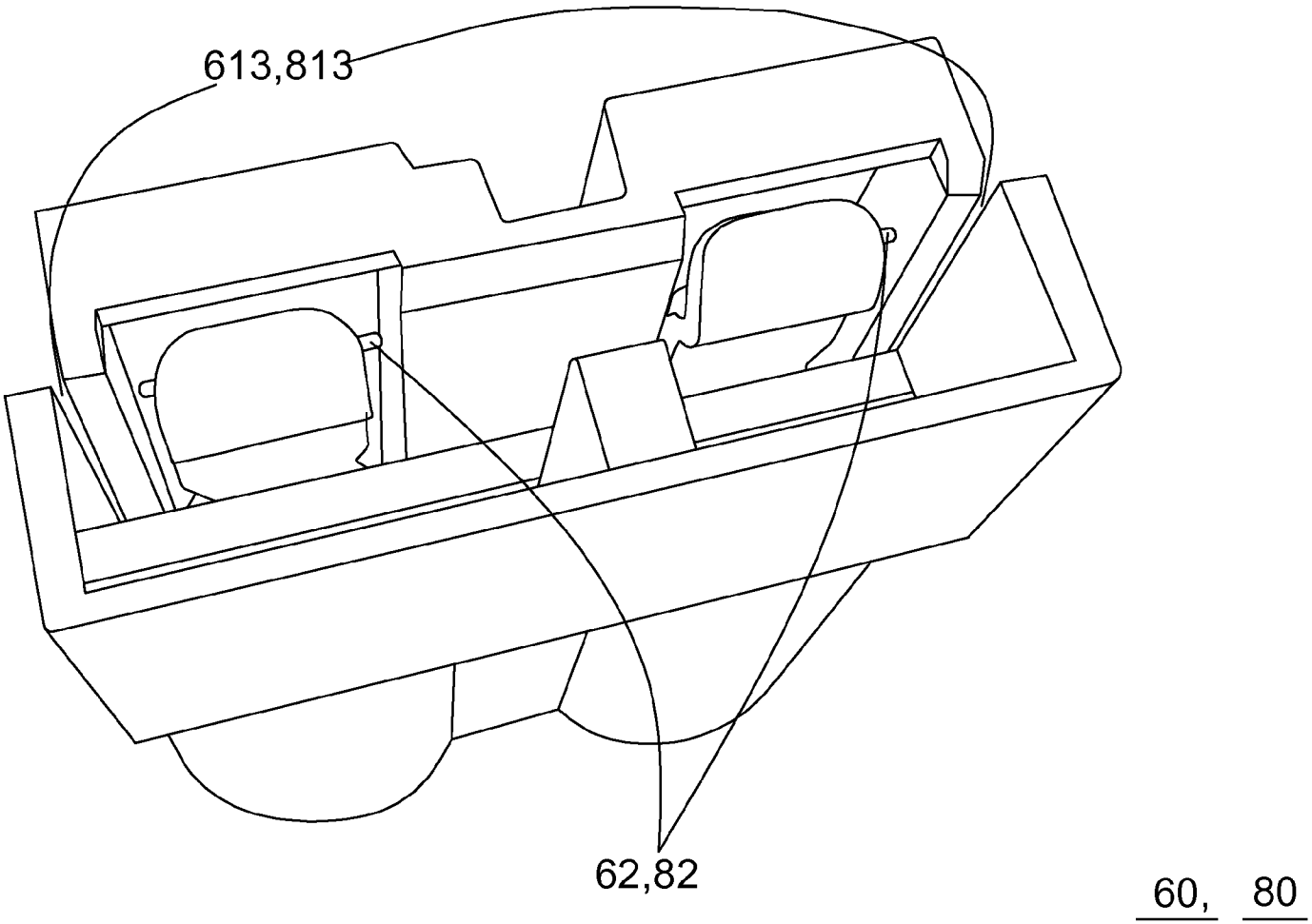
FIG. 4 is another perspective view of the electrical connector in accordance with the present invention.
Figure 5:
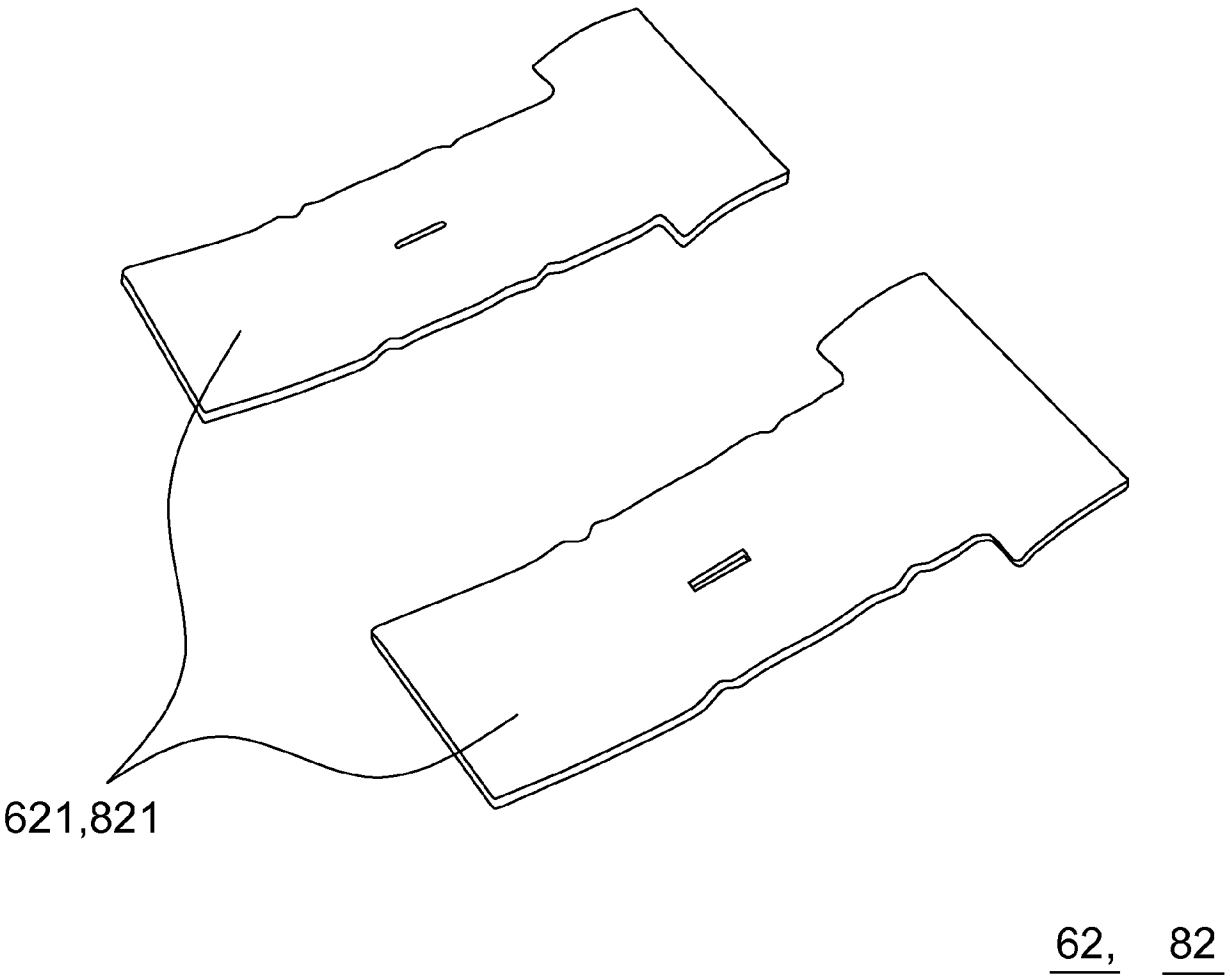
FIG. 5 is a perspective view of the spring in accordance with the present invention.

Refer to FIG. 3, which illustrates the perspective view of the electrical connector according to a second embodiment of the present invention. The electrical connector 60 includes an insulating housing 61, a pair of spring 62 and a pair of conducting terminals 50. First, the insulating housing 61 has an opening portion 611 and a rear portion 612. The two sides of the opening portion 611 are provided with a pair of slits 613, those are mainly for accommodating the other electrical connector 60 inserted therein. The insulating housing 61 is provided with at least one containing space 614 extended from the opening portion 611 to the rear portion 612 for the placement and assembly of at least one spring 62 and at least one conducting terminal 50. Refer to FIGS. 4 and 5. The spring 62 is provided at the bottom of containing space 614 of the insulating housing 61. The spring 62 having a bending portion 621 protruded upward affixes the conducting terminal 50 held in the containing space 614. As the bending portion 621 is pre-deformed, it enhances the stiffness to resist deformation at the bent direction in the structure of the spring itself. The overall assembly of the electrical connector 60 requires the bending portion 621 of the spring 62 to stop at the back of the engaging surface 522 of the conducting terminal 50, thereby forming a tightly coupled position for the overall structure.

The characteristics of the conducting terminal 50 used in the electrical connector are described in the first embodiment.

In this second preferred shown in FIG. 3. The electrical connector has a pair of conducting terminals 50. However, in other configuration, the electrical connector 60 may have one conducting terminal 50, or more than three conducting terminals 50.

Figure 6:
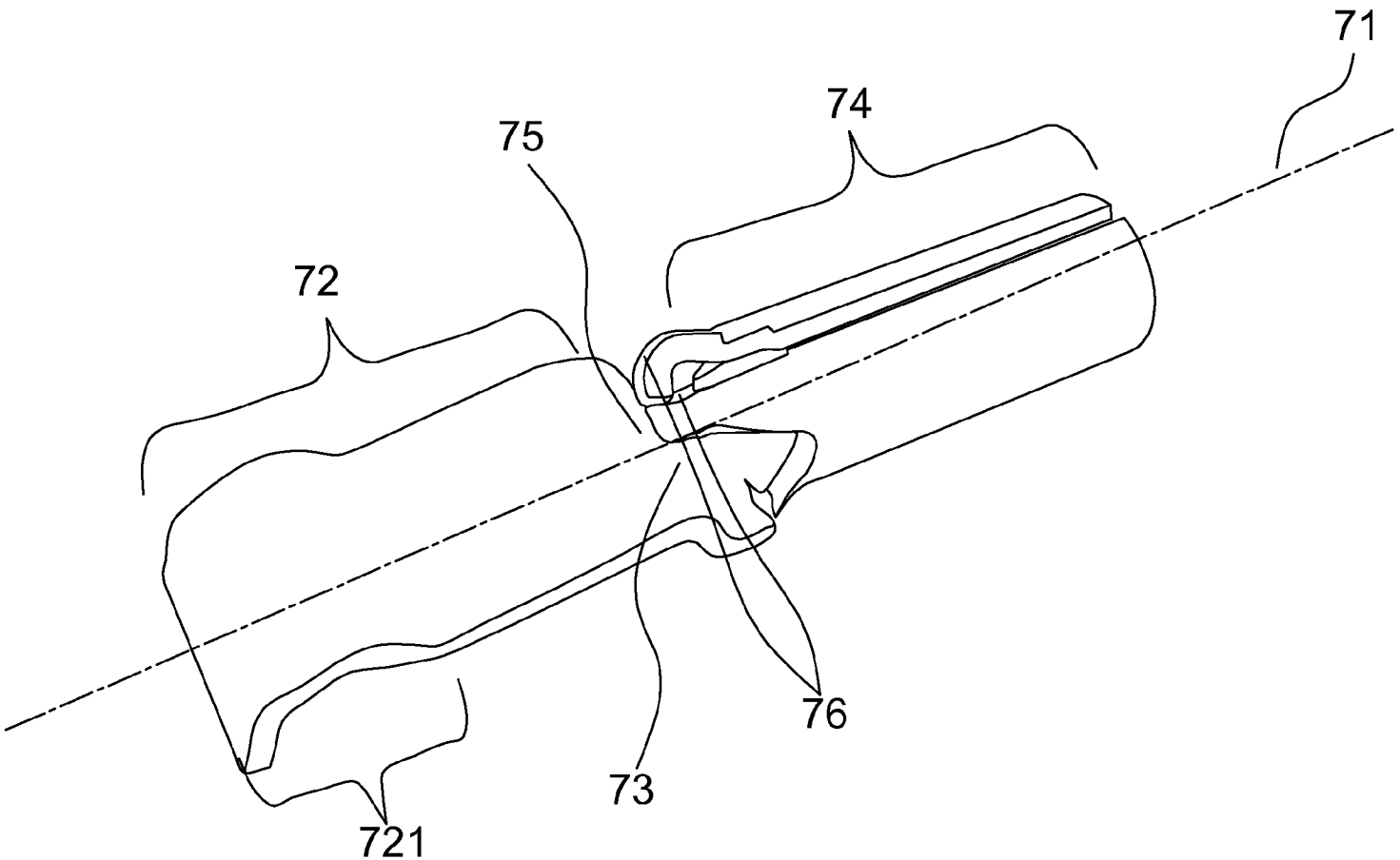
FIG. 6 is a perspective view of another embodiment of the conducting terminal in accordance with the present invention.
Figure 7:
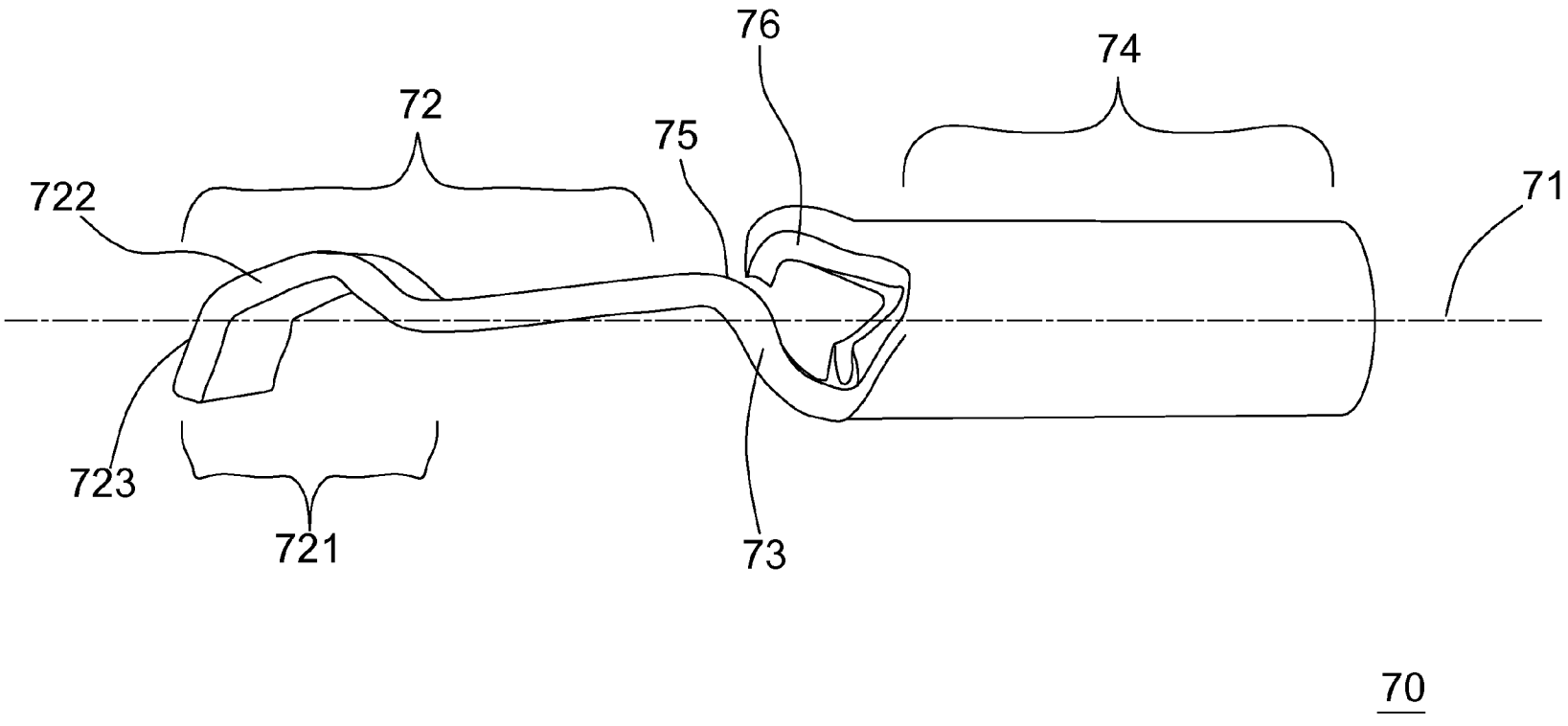
FIG. 7 is a side view of another embodiment of the conducting terminal in accordance with the present invention.

Refer to FIGS. 6 and 7, which respectively illustrate the perspective view and side view of the conducting terminal in a third preferred embodiment of the present invention. The conducting terminal 70 includes a longitudinal axis 71 and a proximal end 72, a lumbar portion 73 and a distal end 74 extended along the longitudinal axis 71. The proximal end 72 is bent in a waved form such that when the conducting terminal 70 is engaged with another conducting terminal, the waved form provides elastic deformation at the same time as the deformation is caused by contact force. A free end 721 of the proximal end 72 has an engaging surface 722. The engaging surface 722 and the lumbar portion 73 have respective normal lines intersecting the longitudinal axis 71 so as to act as a contact surface when the conducting terminal 70 is in connection with another conducting terminal 70.

The distal end 74 is in a barrel shape. If it is fabricated by metal stamping, then a slit is formed along the longitudinal axis; if it is directly make form a tubular part, then it is formed in a simple barrel shape. Between the distal end 74 and the proximal end 72, there is the lumbar portion 73. The lumbar portion 73 is mainly used as a buffer portion intermediating between the varied structures of the terminal. However, due to the repeated plugging of the conducting terminal, fatigue stress is generally concentrated in this portion. A prop surface 75 is provided at the lumbar portion 73 for contacting with a supporting means 76, and dissipating the fatigue stress thereto so as to reduce the deformation.

In order to improve the structural strength of the lumbar portion 73, the present invention provides the supporting means 76 extended from the distal end 74 toward the prop surface 75. As a result, the conducting terminal 70 can be prevented form being destroyed under an excessive deformation caused by an excessively applied force. In the preferred embodiment, the supporting means 76 is configured in pairs and is shaped in a flat shape, a curved shape or any other structure so as to enhance the stiffness to the deformation; wherein it is preferred to have a clearance between the supporting means 76 and the prop surface 75 so as to provide a buffer space for the deformation of the conducting terminal. In order to achieve better electrical contact and stiffness, the prop surface 75 is configured in the manner that a normal line thereof intersects the longitudinal axis 71 at an intersection angle between 40 and 80 degrees. Similarly, the engaging surface 722 is configured in the manner that a normal line thereof intersects the longitudinal axis 71 at an intersection angle between 40 and 80 degrees. The engaging surface 722 is further provided with a slanting portion 723. Furthermore, the slanting portion 723 is configured in the manner that a normal line thereof intersects the longitudinal axis 71 at an intersection angle smaller than that between the normal lines of the engaging surface 722 and the longitudinal axis 71. Particularly, the angle is between 10 and 40 degrees and preferably at 15 degrees.

In order to provide a better structural strength, the above-mentioned prop surface 75 can also be fabricated by metal forming to a curved shape. Although it has more than one normal direction, the structural strength is still good.

Material of the conducting terminal 50 may be preferably selected with high conductivity, such as brass, bronze, copper alloy, aluminum, aluminum alloy, or gold, etc.

For the purpose of high stiffness, material of the conducting terminal 50 may be preferably selected such as stainless steel, K gold, or platinum, etc.

The present invention further provides a fourth preferred embodiment. Refer to FIG. 3, which illustrates the perspective view of the electrical connector. The electrical connector 80 includes an insulating housing 81, a spring 82 and at least one conducting terminal 70. The insulating housing 81 has an opening portion 811 and a rear portion 812. The two sides of the opening portion 811 are provided with a pair of slits 813, those are mainly for accommodating the other electrical connector 80 inserted therein. The insulating housing 81 is provided with at least one containing space 814 extended from the opening portion 811 to the rear portion 812 for the placement and assembly of at least one spring 82 and at least one conducting terminal 70. Refer to FIGS. 4 and 5, which illustrate an enlarged perspective view of the assembly of the electrical connector. The spring 82 is provided at the bottom of the containing space 814 in the insulating housing 81. The spring 82 having a bending portion 821 protruded upward affixes the conducting terminal 70 in the containing space 814. As the bending portion 821 is pre-deformed, it enhances the rigidity to resist deformation at the bent direction in the structure of the spring itself. The overall assembly of the electrical connector 80 requires the bending portion 821 of the spring 82 to stop at the back of the engaging surface 722 of the conducting terminal 70, thereby forming a tightly coupled position for the overall structure.

The characteristics of the conducting terminal 70 are the same as described in the third embodiment.

In this preferred embodiment, the electrical connector 80 has a pair of conducting terminals 70. However, in other configuration, the electrical connector 80 may have one conducting terminal 70, or more than three conducting terminals 70.

The above-mentioned preferred embodiments in accordance with the present invention are not meant to limit claims set forth below. Those skilled in the art should understand and be able to implement the above description. Thus, any substantially equivalent modifications or changes thereof should be in the claimed scope set forth.

What is claimed is:

1. An electrical connector having at least one conducting terminal, said electrical connector comprising:

an insulating housing having a front opening portion and a rear portion, a pair of slits provided on two sides of said front opening portion for accommodating a corresponding electrical connector, said insulating housing provided with at least a containing space extended from said front opening portion to said rear portion;

at least one conductive discrete spring plate provided on a bottom of said containing space within said insulating housing, and having a bending portion protruded upward; and at least one conducting terminal provided on said spring plate so that said bending portion tightly holding said conducting terminal in said containing space, wherein said conducting terminal having a longitudinal axis, a proximal end, a lumbar portion and a distal end extended along said longitudinal axis, characterized in that:

said proximal end of said conducting terminal is bent in a waved form so as to have elastically deforming capability, a free end of said proximal end has an engaging surface having a curve portion and a slanting portion;

said distal end is in a barrel shape, and a prop surface is located at said distal end adjacent to said lumbar portion;

a supporting means is configured in pairs and extended from two sides of said lumbar portion toward said prop surface, each of said pairs of said supporting means is in a curved shape;

a clearance is between said supporting means and said prop surface;

said engaging surface has a first normal line to intersect said longitudinal axis; and said lumbar portion has a third normal line to intersect said longitudinal—axis;

wherein said first normal line of said engaging surface intersects said longitudinal—axis at an intersection angle between 40 and 80 degrees;

and said third normal line of said lumbar portion intersects said longitudinal axis at an intersection angle between 40 and 80 degrees.

2. The electrical connector according to claim 1, wherein said barrel of said distal end has a slit along said longitudinal axis.

3. The electrical connector according to claim 1, wherein said slanting portion has a second normal line to intersect said longitudinal axis at an intersection angle smaller than said intersection angle at which said first normal line of the engaging surface intersects said longitudinal axis.

4. The electrical connector according to claim 1, wherein the material of said conducting terminal is selected from a group consisting of brass, bronze, copper alloy, stainless steel, aluminum, aluminum alloy, gold, K gold and platinum.

* * * * *